US008302375B2

(12) United States Patent
Kriele et al.

(10) Patent No.: US 8,302,375 B2
(45) Date of Patent: Nov. 6, 2012

(54) CUT RESISTANT YARN

(75) Inventors: Johannes Elizabeth Adrianus Kriele, Putte (NL); Giovanni Joseph Ida Henssen, Born (NL); Elisabeth E Müller, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 12/303,148

(22) PCT Filed: May 30, 2007

(86) PCT No.: PCT/EP2007/004758

§ 371 (c)(1),
(2), (4) Date: Nov. 5, 2009

(87) PCT Pub. No.: WO2007/140905

PCT Pub. Date: Dec. 13, 2007

(65) Prior Publication Data

US 2010/0043382 A1 Feb. 25, 2010

(30) Foreign Application Priority Data

Jun. 2, 2006 (EP) ..... 0611477

(51) Int. Cl.
*D02G 3/04* (2006.01)

(52) U.S. Cl. ..... 57/245; 57/246; 57/254; 57/255

(58) Field of Classification Search ..... 57/243–247, 57/252, 254–256
See application file for complete search history.

(56) References Cited

U.S. PATENT DOCUMENTS

| | | | | |
|---|---|---|---|---|
| 4,238,439 | A * | 12/1980 | Hyun | 264/168 |
| 4,428,752 | A * | 1/1984 | Goldenstein | 8/529 |
| 4,777,789 | A | 10/1988 | Kolmes et al. | |
| 5,093,197 | A | 3/1992 | Howard et al. | |
| 5,597,649 | A | 1/1997 | Sandor et al. | |
| 6,341,483 | B1 | 1/2002 | Kolmes et al. | |
| 2003/0129395 | A1 | 7/2003 | Zhu | |
| 2005/0059307 | A1 | 3/2005 | Moeseke | |
| 2008/0305331 | A1 * | 12/2008 | Tam et al. | 428/374 |

FOREIGN PATENT DOCUMENTS

| | | |
|---|---|---|
| EP | 0 445 872 | 9/1991 |
| EP | 1 052 316 | 11/2000 |
| JP | 05-051833 | 3/1993 |
| JP | 2001-20142 | 1/2001 |
| JP | 2007-521412 | 8/2007 |
| WO | WO 94/00627 | 1/1994 |
| WO | 2005/002376 | 1/2005 |

OTHER PUBLICATIONS

Steven B. Warner, Fiber Science, 1995, Prentice Hall, 1st edition, p. 127.*
Written Opinion of the International Searching Authority for PCT/EP2007/004758, mailed Aug. 27, 2007.
Japanese Office Action dated Apr. 17, 2012.

* cited by examiner

*Primary Examiner* — Shaun R Hurley
(74) *Attorney, Agent, or Firm* — Nixon & Vanderhye P.C.

(57) ABSTRACT

Cut resistant yarn containing at least one single yarn, the single yarn containing high performance filaments and/or high performance staple fibers, characterized in that the single yarn containing the high performance filaments and/or the high performance staple fibers has a free volume of at least 15%. The yarn is suited for the production of protective garment, like gloves etc.

15 Claims, No Drawings

CUT RESISTANT YARN

This application is the U.S. national phase of International Application No. PCT/EP2007/004758, filed 30 May 2007, which designated the U.S. and claims priority to Europe Application No. 06011477.4, filed 2 Jun. 2006, the entire contents of each of which are hereby incorporated by reference.

The invention relates to a cut resistant yarn containing at least one single yarn, the single yarn containing high performance filaments and/or high performance staple fibers. The invention also relates to protective garment containing the cut resistant yarn and a process for producing the cut resistant yarn.

Cut resistant yarns containing high performance fibers and garments containing the yarns are known. Cut resistant yarns are for example used in garments intended to protect persons working in the meat industry, the metal industry and the wood industry from being cut. Examples of such garments include gloves, aprons, trousers, cuffs, sleeves, etc.

Examples of high performance fibers used in cut resistant yarns include aramid fibers and ultra-high molecular weight polyolefin fibers. Especially garments produced out of yarns comprising fibers of ultra-high molecular weight polyolefin show a considerable wear comfort.

In EP 445872 a cut resistant yarn is disclosed containing at least one single yarn, the single yarn being spun of staple fibers of ultra-high molecular weight polyethylene, the single yarn being twisted with at least one metal wire. A garment containing the yarn shows improved cut resistance, however with respect to the comfort of the wearer there is room for further improvement. It is very important that the garment shows good wear comfort, since the persons in industry involved have to wear the garments for considerable long periods, while maintaining high productivity. If the comfort is inadequate, people tend to get fatigued, or will even refrain from wearing the protective garment. This increases the risk that accidents happen and that injuries occur.

Object of the invention therefore is to provide a cut resistant yarn enabling the production of protective garment showing improved comfort for the wearer.

Surprisingly, this object is obtained by a cut resistant yarn containing at least one single yarn, the single yarn containing high performance filaments and/or high performance staple staple fibers, the single yarn having a free volume of at least 15%.

Due to the high free volume in the single yarn, the single yarn and therefore also the yarn according to the invention will have a low density. In many applications the yarn according to the invention will be constructed with a weight per unit of length that is comparable to the known yarn. In that case the yarn according to the invention will have a higher volume than the known yarn.

The free volume is determined by the space in the single yarn that is not occupied by the filaments, staple fibers or other constituents of the single yarn but that is occupied by air. Therefore the single yarn has a density of less than:

$$C.\ \sum_{x=1}^{n}(\phi_x\delta_x) \qquad \text{Form. I}$$

wherein $\phi_x$ is the volume fraction of the xth filament, staple fiber or further constituent if present in the yarn, $\delta_x$ is the density of the xth filament, staple fiber or further constituent in the single yarn and C=0.85.

The density of the single yarn and accordingly the density of the novel yarn according to the invention is lower than the density of the known yarns. To obtain the higher free volume and lower density special measures have to be taken, for example during production of the single yarn.

WO94/00627 discloses a spun yarn containing staple fibers of ultra-high molecular weight polyethylene and staple fibers of aramid. The aramid staple fibers are used to overcome problems with spinning of the yarn, due to the slipperiness of the ultra-high molecular weight polyethylene fibers. No special treatment to decrease the density of the yarn is given.

In US 2003/0129395 a yarn containing aramid fibers and fibers of a synthetic polymer having a melting temperature between 200 and 300° C. is disclosed. A heat treatment is given to the yarn to increase the cohesion between the fibers. Because of this the stiffness and abrasion resistance of the yarn increases. A decrease in density does not take place.

A garment containing the cut resistant yarn according to the invention shows improved comfort to the wearer. The garment is very flexible and fits well to the body contour.

A further advantage of the cut resistant yarn according to the invention is that it shows improved cut resistance.

Yet a further advantage is that the cut resistant yarn according to the invention shows improved lifetime so also improving the level of protection of the garment for a longer period of time.

Preferably the cut resistant yarn consists of one or more single yarns containing the high performance filaments and/or high performance staple fibers. A garment produced from such a cut resistant yarn shows an optimal combination of wear comfort and cut resistance. If the cut resistant yarn consists of one single yarn, the cut resistant yarn is equal to that one single yarn.

However cut resistant yarns according to the invention having all kind of structures may be produced, as long as the yarns contains at least one single yarn having the required low density. It is for example possible that the cut resistant yarn contains glass filaments or one or more metal wires, that extend in the centre of the yarn, the metal wires being wrapped with one or more single yarns containing the high performance filaments and/or high performance staple fibers. It is also possible that one or more of the single yarns are twisted with a metal wire or glass filaments, or with a single yarn containing or existing of filaments or staple fibers of a different polymer, for example polyester, or nylon.

Examples of metal wires that may be used in the yarn according to the invention include copper wire, steel wire, bronze wire and aluminum wire. Preferably a wire of annealed stainless steel is used.

High performance filaments and staple fibers preferably have a tenacity of at least 0.5 GPa, more preferably at least 1 GPa, still more preferably at least 1.5 GPa, most preferably at least 2 GPa. Good examples of such filaments and staple fibers are filaments and staple fibers of polyaramid, of ultra-high molecular weight polyolefin and of liquid crystal polymers (LCP).

Preferably the filaments and staple fibers are of ultra-high molecular weight polyolefin, more preferably of ultra-high molecular weight polyethylene. Such filaments and staple fibers are preferably produced according to the so-called gel-spinning process as for example described in EP 0205960 A, EP 0213208 A1, U.S. Pat. No. 4,413,110, GB 2042414 A, EP 0200547 B1, EP 0472114 B1, WO 01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning at least one filament from a solution of ultra-high molecular weight polyethylene in a spin solvent; cooling the filament obtained to form a gel filament; removing at least partly the spin solvent from the gel filament; and drawing the filament in at least one drawing step before, during or after removing spin solvent. Suitable spin solvents include for example paraffins, mineral oil, kerosene or decalin. Spin solvent can be removed by evaporation, by extraction, or by a combination of evaporation and extraction routes.

The ultra-high-molecular weight linear polyethylene used for the preparation of the filaments preferably has a weight average molecular weight of at least 400,000 g/mol.

The filaments may be converted into staple fibers according to well-known techniques, for example by stretch breaking.

Preferably the single yarn contains high performance staple fibers.

The single yarn preferably has a free volume of at least 20%, more preferably at least 25%, still more preferably at least 30%, still more preferably at least 35%, still more preferably at least 40%, most preferably at least 45%.

Therefore the single yarn containing the high performance filaments and/or staple fibers preferably has a density of less than:

$$C.\ \sum_{x=1}^{n}(\phi_x\delta_x) \qquad \text{Form. I}$$

wherein $\phi_x$ is the volume fraction of the xth filament, staple fiber or further constituent in the single yarn, $\delta_x$ is the density of the xth filament, staple fiber or further constituent in the single yarn and C=0.8.

Preferably C=0.75, more preferably C=0.7, even more preferably C=0.65, even more preferably C=0.6, most preferably C=0.55.

The single yarn of the cut resistant yarn according to the invention may comprise, next to the high performance filaments and/or staple fibers, second filaments or staple fibers, third filaments or staple fibers or even nth filaments or staple fibers.

If the single yarn consists of one kind of filaments or staple fibers, than n=1 and the density of the single yarn is less than $$C.\delta \qquad \text{Form. II}$$

wherein δ is the density of the filaments or staple fibers and C has the meaning as indicated above.

Preferably the single yarn contains high performance filaments and/or high performance staple fibers and a further component that may shrink or curl by a physical or chemical treatment, preferably a heat treatment. The further component is preferably a filament or a staple fiber, most preferably a staple fiber.

In a preferred embodiment the single yarn contains high performance staple fibers and second staple fibers as the second component that may shrink or curl by a heat treatment.

In that case the density of the single yarn is less than:

$$C.(\phi_1\delta_1+\phi_2\delta_2) \qquad \text{Form. III}$$

wherein $\phi_1$ is the volume fraction of the high performance staple fibers, $\delta_1$ is the density of the high performance staple fibers, $\phi_2$ is the volume fraction of the second staple fibers, $\delta_2$ is the density of the second staple fibers and C has the meaning as indicated above.

The invention also relates to a process for producing a yarn according to the invention containing the steps of:

a) providing high performance filaments or high performance staple fibers
b) providing filaments or staple fibers that may shrink or curl by a physical or chemical treatment
c) spinning a precursor single yarn containing the filaments or staple fibers of step a) and the filaments or staple fibers of step b)
d) optionally spinning a precursor yarn containing at least one precursor single yarn of step c)
e) give a treatment to the precursor single yarn obtained in step c) or if a precursor yarn is produced in step d) give a treatment to the precursor yarn, to shrink the filaments or staple fibers of step b) in the length direction or to curl the filaments or staple fibers.

Preferably the invention also relates to a process for producing a yarn, containing the steps of:

a) producing a sliver of the high performance staple fibers,
b) producing a sliver of second staple fibers that may shrink or curl by a physical or chemical treatment,
c) mixing the slivers obtained in step a) and b) to a flyer containing a mixture of the two staple fibers,
d) spinning a precursor single yarn containing the high performance staple fibers and the second staple fibers from the flyer,
e) optionally spinning a precursor yarn containing at least one precursor single yarn obtained in step d),
f) give a treatment to the precursor single yarn obtained in step d), or if a precursor yarn is produced give a treatment to the precursor yarn, to shrink the second staple fiber in the length direction or to curl the second staple fiber.

The sliver of the high performance staple fibers and the sliver of the second staple fibers may be produced by stretch breaking yarns of the corresponding continuous filaments. As the second staple fibers all kind of staple fibers may be used, as long as it is possible to shrink the staple fibers in their length direction or to curl the staple fiber, for carrying out step f) of the process according to the invention.

In one preferred embodiment as filaments or staple fibers that may shrink or curl, polyacrylonitril filaments or staple fibers are used. In this way a cut resistant yarn comprising a single yarn having a very low density and accordingly a high volume may be obtained. Furthermore the cut resistant yarn may easily be obtained in all kind of colors.

In another preferred embodiment as filamenst or staple fiber that may shrink or curl, a bi-component filament or staple fiber is used, for example a filament or staple fiber of bi-component nylon or bi-component polyester. Preferably, a filament or a staple fiber of a bi-component polyester is used. Such staple filaments and fibers are for example supplied by Invista. Such a filament or fiber comprises two filament or fiber elements, extending in the length direction of the filament or fiber being joined together at one face of each element. Preferably, one of the elements is of PET and the other element of a co-polyester.

In the preferred embodiment both slivers may be blended by using well known equipment for this purpose, for example a blending and drafting machine. In this way a sliver is obtained comprising an intimate blend of the high performance staple fibers and of the second staple fibers.

The precursor single yarn may be spun by using well known equipment for this purpose, for example worsted hollow spinning equipment or ring spinning equipment. In case the single yarn contains filaments and staple fibers dreff spinning equipment may be used.

Preferably, as the treatment to shrink or to curl the filaments or second staple fiber, a heat treatment is applied. The treatment may be carried out by applying hot air or steam or a hot liquid to the precursor single yarn or, if a precursor yarn is produced, to the precursor yarn. If the yarn is dyed, advantageously the heat treatment is given during the dying process, that takes place in a hot dying bath. Important is of course that the heat treatment is at a temperature low enough not to deteriorate the properties of the high performance staple fibers. If polyacrylonitril filaments or staple fibers are used, the treatment is preferably carried out at a temperature between 80 and 120° C. The duration of the treatment is among others dependent from the thickness of the precursor single yarn, or if a precursor yarn is produced from the thickness of the precursor yarn, and can easily be determined by the skilled person. If bi-component polyester or bi-component nylon filaments or staple fibers are used, the treatment is preferably carried out at a temperature of between 100 and 120° C.

Preferably, in the process according to the invention step e) is carried out, spinning a precursor yarn comprising at least one precursor single yarn. In that case after the treatment in step f) the cut resistant yarn according to the invention is obtained.

However, it is also possible to delete step e) from the process according to the invention. This will for example be the case if the yarn according to the invention consists of one single yarn, that immediately is obtained after step f). However it is also possible to delete step e) and to produce, after the treatment in step f) to the single precursor yarn, a cut resistant yarn according to the invention by incorporating the single yarn in a cut resistant yarn optionally containing further elements. This may be accomplished for example by twisting together two or more of the so obtained single yarns, by twisting one or more single yarns around a metal wire, by twisting the single yarns together with a metal wire etc.

The single yarn of the cut resistant yarn according to the invention may contain from 95-30 weight (wt) % of high performance filaments or high performance staple fibers.

Preferably the single yarn of the yarn according to the invention contains between 95 weight (wt) % and 50 wt. % of the high performance filaments or high performance staple fibers and between 5 wt. % and 50 wt. % of the filaments or staple fibers that may shrink or curl upon a physical or chemical treatment.

More preferably the single yarn of the yarn according to the invention contains between 90 weight (wt) % and 55 wt. % of the high performance filaments or high performance staple fibers and between 10 wt. % and 45 wt. % of the filaments or staple fibers that may shrink or curl.

Most preferably the single yarn of the yarn according to the invention contains between 80 weight (wt) % and 60 wt. % of the high performance filaments or high performance staple fibers and between 20 wt. % and 40 wt. % of the filaments or staple fibers that may shrink or curl.

Preferably the single yarn a contains staple fibers of ultra-high molecular weight polyethylene and staple fibers of polyacrylonitril.

The cut resistant yarns according to the invention are for example used in garments intended to protect persons from being cut, for example working in the meat industry, the metal industry and the wood industry. The invention also relates to such garments. Good examples of such garments include gloves, aprons, trousers, cuffs, sleeves, etc.

Comparative Experiment A

A sliver containing high performance staple fibers of ultra-high molecular weight polyethylene was obtained by stretch breaking of Dyneema™ SK 75 yarn 1760 dtex (yarn comprising filaments of ultra-high molecular weight polyethylene, delivered by DM Dyneema in the Netherlands) by using a standard stretch breaking machine. The sliver was spun into a single yarn. Two single yarns were finally twisted into a cut resistant yarn, having a final yarn count of Nm 34/2 (Number metric is 34 km/kg, two single yarns).

The single yarn had a density of 830 kg/m$^3$. The density was calculated after measuring the weight of one meter of single yarn and measuring the diameter of the yarn from a projection of the single yarn at a photographic plate.

The density of the Ultra High Molecular weight Polyethylene is 970 kg/m$^3$. Using form. II results in a free volume for the single yarn of 14%. The corresponding value for the constant C in form. II is 0.86.

EXAMPLE I

A sliver containing high performance staple fibers of ultra-high molecular weight polyethylene was obtained by stretch breaking of Dyneema™ SK 75 yarn 1760 dtex by using a standard stretch breaking machine. Furthermore a sliver containing staple fibers of polyacrylonitril was obtained by stretch breaking of PAN filaments having a titer of 2.2 dtex per filament (Dralon™ filaments, delivered by Bayer in Germany) by using a standard stretch breaking machine. Both slivers were mixed by using an NSC drafting machine, delivered by NSC in France. A flyer was obtained comprising an intimate mixture of 80 wt. % of the ultra-high molecular weight polyethylene staple fibers and 20 wt. % of the polyacrylonitril staple fibers as the second staple fibers. The flyer was spun into a precursor single yarn by.

A precursor yarn was produced by twisting 2 precursor single yarns together. The precursor yarn was heat treated by using a Hacoba™ apparatus. Steam having a temperature of 100° was applied during 60 seconds. The so obtained cut resistant yarn according to the invention has a final yarn count of Nm 31/2 (Number metric is 31 km/kg, two single yarns). A single yarn had a density of 740 kg/m$^3$. From the yarn a glove was produced, by knitting the yarn. The glove was light in weight, was soft and very flexible.

The density of the ultra-high molecular weight polyethylene staple fibers and of the PAN staple fibers is regarded as being equal to the density of the corresponding polymers, which is 970 kg/m$^3$ for the ultra-high molecular weight polyethylene and 1300 kg/m$^3$ for the PAN. The volume fraction of the ultra-high molecular weight polyethylene staple fibers is calculated to be 0.843, the volume fraction of the PAN staple fibers is calculated to be 0.157. Filling in formula III results in:

The density of the single yarn is smaller than:

$$C.(\phi_1\delta_1+\phi_2\delta_2)=C.(0.843\times970+0.153\times1300)=1017.C.$$

Therefore in this case at a density for the single yarn of 740 kg/m$^3$ C is calculated to have a value of at least 740/1017=0.73. This corresponds with a free volume of 27%.

EXAMPLE II

Example I was repeated, however the single yarn contained 60 wt. % of the ultra-high molecular weight polyethylene staple fibers and 40 wt. % of the Pan staple fibers.

The density of the single yarn is 480 kg/m$^3$.

The invention claimed is:

1. A cut resistant yarn comprising at least one single yarn, the single yarn containing:

(a) a first component comprising ultra-high molecular weight polyolefin filaments and/or ultrahigh molecular weight polyolefin staple fibers; and (b) a second component comprising synthetic filaments or synthetic staple fibers that are capable of shrinking or curling in response to a physical or chemical treatment, wherein said single yarn has a free volume of at least 15% obtained by applying a physical or chemical treatment on said single yarn.

2. The cut resistant yarn according to claim 1, wherein the ultra-high molecular weight polyolefin is ultra-high molecular weight polyethylene.

3. The cut resistant yarn according to claim 1, wherein the single yarn has a free volume of at least 20%.

4. The cut resistant yarn according to claim 1, wherein the single yarn has a free volume of at least 25%.

5. The cut resistant yarn according to claim 1, wherein the single yarn has a free volume of at least 30%.

6. The cut resistant yarn according to claim 1, wherein the single yarn comprises between 95 weight (wt) % and 30 wt. % of ultra high molecular weight polyolefin filaments and/or ultra high molecular weight polyolefin staple fibers.

7. The cut resistant yarn according to claim 1, wherein the second component comprises polyacrylonitrile filaments or polyacrylonitrile staple fibers.

8. Process for producing a cut resistant yarn having a free volume of at least 15%, comprising the steps of:

a) providing ultra-high molecular weight polyolefin filaments or ultra-high molecular weight polyolefin staple fibers, b) providing synthetic filaments or synthetic staple fibers capable of shrinking or curling in response to a physical or chemical treatment, c) spinning a precursor single yarn containing the filaments or staple fibers of step a) and the filaments or staple fibers of step b), d) optionally spinning a precursor yarn containing at least one precursor single yarn of step c), e) subjecting the precursor single yarn obtained in step c) to a physical or chemical treatment or if a precursor yarn is produced in step d) subjecting the precursor yarn of step d) to the treatment, to shrink the synthetic filaments or synthetic staple fibers of step b) in the length direction or to curl the synthetic filaments or synthetic staple fibers.

9. A process for producing a cut resistant yarn having a free volume of at least 15%, comprising the steps of:

a) producing a sliver of the ultra-high molecular weight polyolefin staple fibers, b) producing a sliver of second synthetic staple fibers capable of shrinking or curling in response to a physical or chemical treatment, c) mixing the slivers obtained in step a) and b) to a flyer containing a mixture of the two staple fibers, d) spinning a precursor single yarn containing the ultra-high molecular weight polyolefin staple fibers and the second staple fibers from the flyer, e) optionally spinning a precursor yarn containing at least one precursor single yarn obtained in step d), f) subjecting the precursor single yarn obtained in step d) to a physical or chemical treatment or if a precursor yarn is produced in step e) subjecting the precursor yarn of step e) to the treatment, to shrink the synthetic second staple fibers in the length direction or to curl the synthetic second staple fibers.

10. The process according to claim 8 or 9, wherein the treatment to shrink or curl the filament and/or staple fiber is a heat treatment.

11. A garment comprising the yarn of claim 1.

12. A cut resistant yarn comprising at least one single yarn, the single yarn containing high performance filaments having a tenacity of at least 0.5 GPa, and/or high performance staple fibers having a tenacity of at least 0.5 GPa, and a further, shrunk or curled synthetic component, wherein the single yarn containing the high performance filaments and/or high performance staple fibers has a free volume of at least 15%.

13. The cut resistant yarn according to claim 1, wherein the single yarn comprises between 95 weight (wt) % and 50 wt. % of ultra-high molecular weight polyolefin filaments and/or ultra-high molecular weight polyolefin staple fibers.

14. The cut resistant yarn according to claim 1, wherein the single yarn comprises between 95 weight (wt) % and 55 wt. % of ultra-high molecular weight polyolefin filaments and/or ultra-high molecular weight polyolefin staple fibers.

15. The cut resistant yarn according to claim 1, wherein the single yarn comprises between 80 weight (wt) % and 60 wt. % of ultra-high molecular weight polyolefin filaments and/or ultra-high molecular weight polyolefin staple fibers.

* * * * *